United States Patent [19]

Klygis

[11] 4,385,691

[45] May 31, 1983

[54] PACKAGE UNIT CARRIER

[75] Inventor: Mindaugas J. Klygis, Barrington, Ill.

[73] Assignee: Illinois Tool Works Inc., Chicago, Ill.

[21] Appl. No.: 324,724

[22] Filed: Nov. 25, 1981

[51] Int. Cl.[3] ..... B65D 85/62; B65D 75/56; B65D 71/02

[52] U.S. Cl. ..... 206/150; 206/428

[58] Field of Search ..... 206/428, 162, 150; 229/29 B, 20 BC, 89, 52 AL

[56] References Cited

U.S. PATENT DOCUMENTS

| | | | |
|---|---|---|---|
| 2,809,861 | 10/1957 | Socke | 206/431 |
| 2,856,069 | 10/1958 | Felber | 206/431 |
| 3,930,578 | 1/1976 | Stein | 206/150 |
| 4,269,308 | 5/1981 | Platt | 206/150 |
| 4,269,314 | 5/1981 | Barrash | 206/428 |

*Primary Examiner*—William T. Dixson, Jr.
*Assistant Examiner*—Brenda J. Ehrhardt

[57] ABSTRACT

A plastic band is provided for encircling and combining into a single package two six-pack assembly of cans into a package of 12 cans, or similarly for assembling eight bottles. The plastic carrier or band of the present invention encircles the outside of the assembly of cans or bottles, and further provides a central stabilizing band or strap.

27 Claims, 10 Drawing Figures

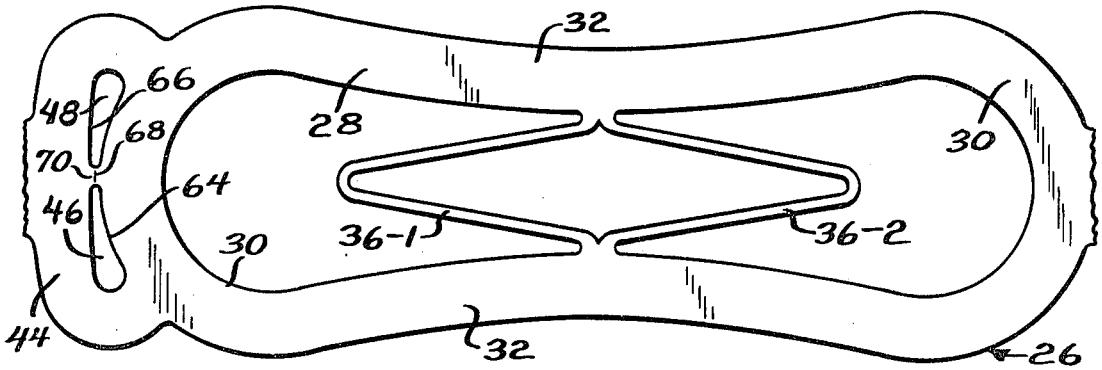
FIG. 3
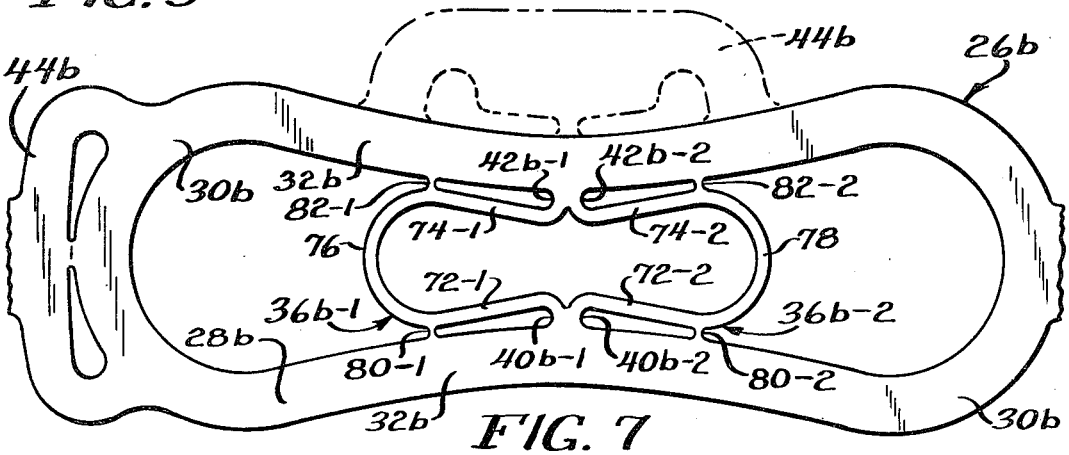
FIG. 7
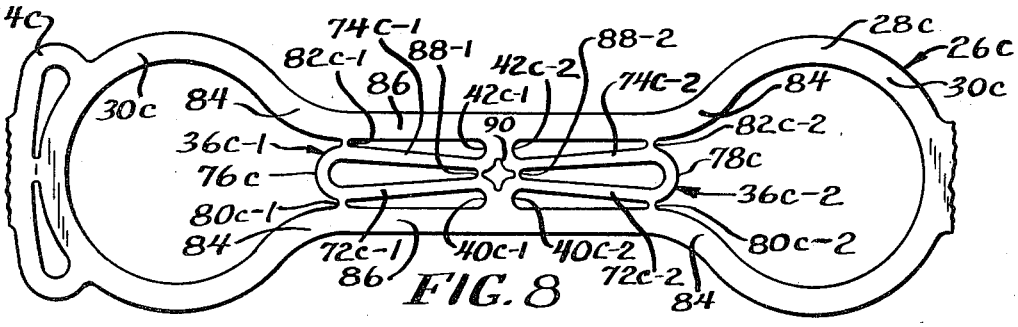
FIG. 8
FIG. 9
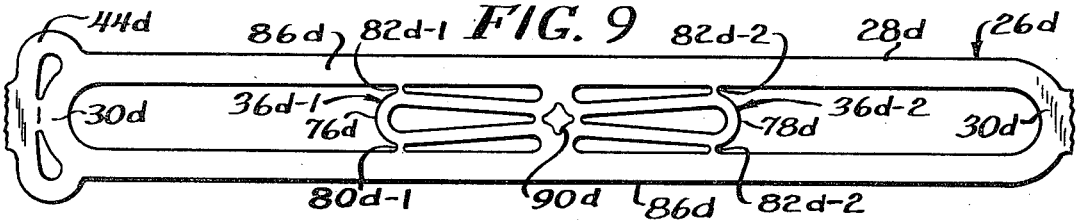
FIG. 10
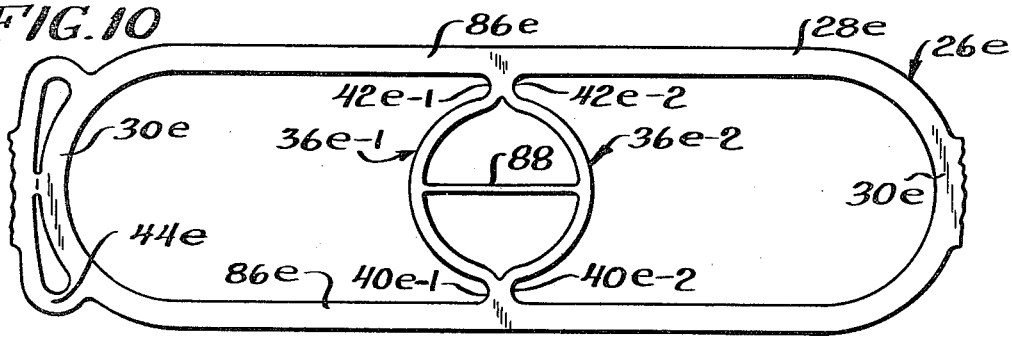

PACKAGE UNIT CARRIER

RELATED APPLICATION

The present application is related to application Ser. No. 324723, filed Nov. 25, 1981, both the present and related application being assigned to Illinois Tool Works Inc., Chicago, Ill.

BACKGROUND OF THE INVENTION

Various types of carriers have been revealed in the patent arts and have been used commercially for assembling a predetermined number of containers, often six in number, for carrying of the containers. Typically, six cans may be carried together, and in a preferred form of package there is a sheet of plastic having six apertures therein respectively slightly less in diameter than the cans, so that the plastic material is stretched about the respective cans in generally inverted conical shape, thus securely underlying the can beads to prevent undesired withdrawal of the cans. As is known, a lateral movement of a can stretches the respective encircling band so that the can can be tipped from carrying position. Such carriers are shown, for example, in U.S. Pat. Nos. 2,874,835 and 3,874,502. Larger numbers of cans have been handled by similar carriers, see for example, U.S. Pat. No. 4,018,331 shows a carrier of the type in question for 12 cans.

Under some circumstances a package of 12 cans may be somewhat unstable or difficult to carry, and in U.S. Pat. No. 4,269,308 there is shown and described a plastic encircling band which circumscribes the 12 cans and holds them in close contiguous relation. The band is provided with a handle for carrying of the 12 pack.

OBJECTS AND SUMMARY OF THE PRESENT INVENTION

It is an object of the present invention to provide an encircling band carrier for a plurality of cylindrical containers which may be otherwise secured together, which carrier ensures stability of the resulting package of containers.

More specifically, it is an object of this invention to provide an integral band plastic carrier for a double six pack of cans, or a double four pack of bottles in which each of the subpackages is fully encircled.

In achieving the foregoing and other objects in accordance with the present invention, a plastic package unit is provided which completely encircles a group of cylindrical containers, such as a double six pack of cans, or a double four pack of bottles. A subsidiary dividing band is provided which lies between the subpacks, such as the two six packs of cans, whereby each subpack is retained in stable condition independently, while the total package is also retained in stable condition. The band or package unit is initially provided stamped from a sheet of plastic material in collapsed condition, with the outer portion thereof forming the overall encircling band, and with an inner portion providing a collapsed separating band. Successive package units are integrally joined together in an elongated strip, and are separated preferably after assembly with the cans or other containers.

THE DRAWINGS

The present invention will best be understood from the following description when considered in conjunction with the accompanying drawings wherein:

FIG. 3 is a modification of the invention as shown in FIG. 2 with the handle at one end rather than along the side;

FIG. 7 is a view similar to FIG. 3 showing a somewhat different configuration of parts;

FIG. 8 is a view generally similar to FIG. 7 and showing a further modification;

FIG. 9 illustrates a further modification; and

FIG. 10 illustrates another modification of the present invention.

DETAILED DESCRIPTION OF THE ILLUSTRATED EMBODIMENT

Figure 1:
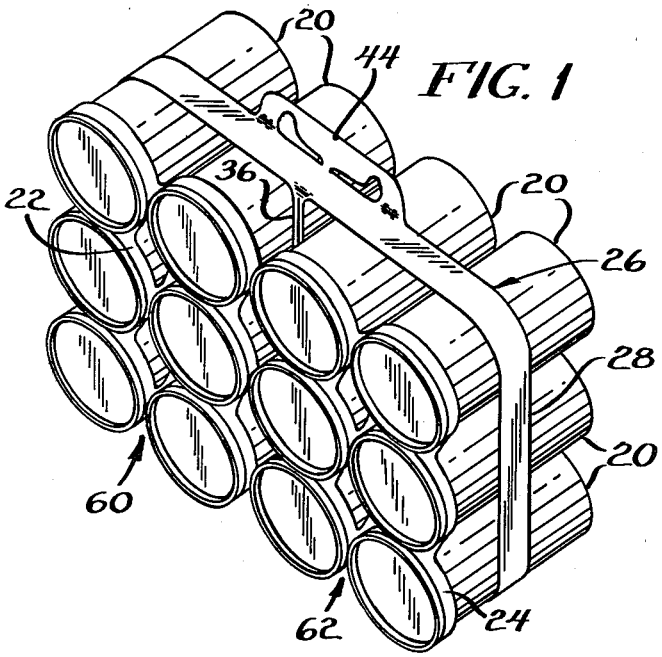
FIG. 1 is a perspective view of a pair of six packs secured together by a package unit or band constructed in accordance with the principles of the present invention.
Figure 5:
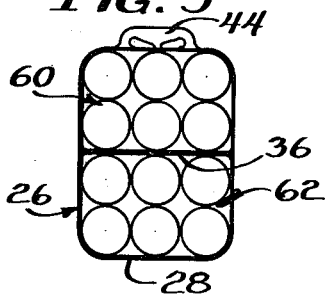
FIG. 5 is a somewhat simplified view on a reduced scale showing the carrier or package unit of FIG. 3 assembled with a double six pack of cans.
Figure 2:
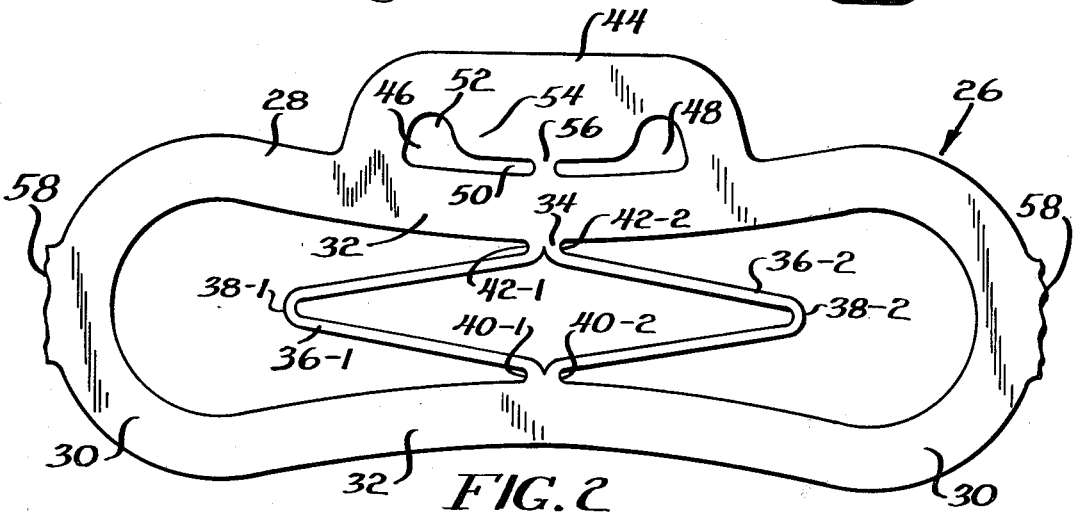
FIG. 2 is a plan view of one of the package units or bands of the present invention prior to assembly with cans or other containers, and showing a handle along the long dimension for carrying of the resulting package.

Referring now in greater particularity to the drawings, and first to FIGS. 1, 2 and 5, there will be seen a plurality of cylindrical containers, specifically cans 20 totaling 12 in the illustrative example. As seen in FIG. 1 the cans are displayed with their axes in horizontal disposition in four columns of three cans each. The two left columns are secured together by a plastic can carrier 22, preferably made of polyethylene, the carrier shown in the aforesaid U.S. Pat. No. 2,874,835 being illustrative. A similar carrier 24 secures the two right columns of cans together. There are thus two six packs of cans which could be carried separately, generally with the can axes in vertical position. Although such carriers are set forth in detail in prior art patents, such for example the aforesaid U.S. Pat. No. 2,874,835, it is noted by way of summary at this point that each such carrier comprises an apertured sheet having six apertures therein, each slightly less in diameter than a can, thus effectively providing six separate bands which aggressively grip the cans beneath the beads thereof. Inherent resilient or stretchable characteristics of the plastic material allow a can to be pulled a slight distance sideways to stretch the respective band, whereby the can can be tipped away from the respective carrier.

In many instances it is convenient to carry 12 cans as a unit, rather than six. Thus, in accordance with the present invention a 12 pack band or package unit carrier 26 is provided.

The shape of the 12 pack band or package unit carrier 26 in blank form before assembly with the cans is shown in FIG. 2, and comprises a continuous outer strip 28 having arcuate end portions extending over greater than a semicircle and join to elongated reversely curved portions 32 integrally interconnecting the arcuate portions. The strip 28 is of uniform width and at its vertical centerline is provided with integral attachment points 34 for narrower V-shaped strips 36-1 and 36-2 arranged horizontally in mirror-image relation. The apices of the strips 36-1 and 36-2 are rounded as indicated at 38-1 and 38-2, while the roots 40-1 and 40-2, and 42-1 and 42-2 are also rounded to avoid stress areas that might tear.

The pack band or package unit carrier 26 is completed by a handle 44 integral with the strip 28. The handle is symmetrical about the vertical midline of the carrier and is integral with the reversely curved portion 32. The handle 44 is provided with two apertures 46 and 48 in mirror-image relation. Since the apertures are of the same shape, only the left one is described, and includes an elongated, rather narrow opening 50 running the length of the aperture 46, and having a generally circular enlargement 52 at the upper edge of the narrow portion 50 and at the left end thereof. This leaves a flap 52 which can be folded up. An integral tab 56 on the vertical midline of the carrier connects the central portion of the handle with the strip 28. The first two fingers of a hand may be inserted through one of the apertures 46 and 48, while the last two fingers are inserted through the other of these apertures. The flap 54 in each instance rolls up to present a smooth, surface engagement with the fingers, rather than a sharp edge. This promotes comfort of the person doing the carrying, and also inhibits tearing of the plastic material.

A succession of 12 pack bands or package unit carriers 26 is provided in the form of a continuous web, and ragged lines 58 at either end in FIG. 2 indicates where successive carriers are supplied integrally joined together. The connection preferably is severed during or immediately prior to assembly with a pair of six packs, hereinafter respectively referred to by numerals 60 and 62.

As shown in FIG. 1, the strip 28 is extended around the two six packs 60 and 62 with the respective intermediate strips 36-1 and 36-2 pulling together as a single, straight strip 36. As will be appreciated, the length of the strip 28 and of the strip 36 are such that they will fit in the positions just shown and described, each under some tension. Accordingly, all of the cans are held in tight assemblage whereby the double six pack can conveniently be carried by the handle 44 without danger of any of the cans coming loose either from the package unit carrier 26, or from the respective six carriers 22 and 24.

A modification of the invention as just described is shown in FIGS. 3 and 5. In this embodiment of the invention the parts are essentially identical with those previously described and are correspondingly numbered. The distinction is that the handle 44 has been moved to the left end of the strip 28. The handle is provided with two apertures 60 and 62, again in mirror-image relation. Due to the shape of the arcuate end portion 30 the inner edge of each aperture is a continuous curve at 64, while the outer edge 66 thereof is straight. This results in a relatively large dimension at the maximum upper and lower vertical limits, but with a very restricted opening adjacent the horizontal centerline. Accordingly, the integral center tab 68 may be scored or otherwise weakened as indicated at 70 so that when it is desired to pick up a double six pack the tab 68 may be readily torn to allow all four fingers to be inserted comfortably in the apertures 64 and 66.

Figure 6:
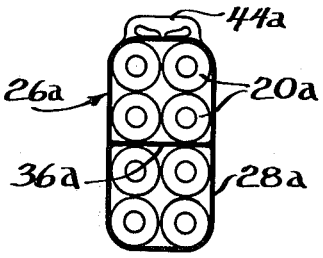
FIG. 6 is a view similar to FIG. 5 showing the carrier or unit of FIG. 4 assembled with a double four pack of bottles.
Figure 4:
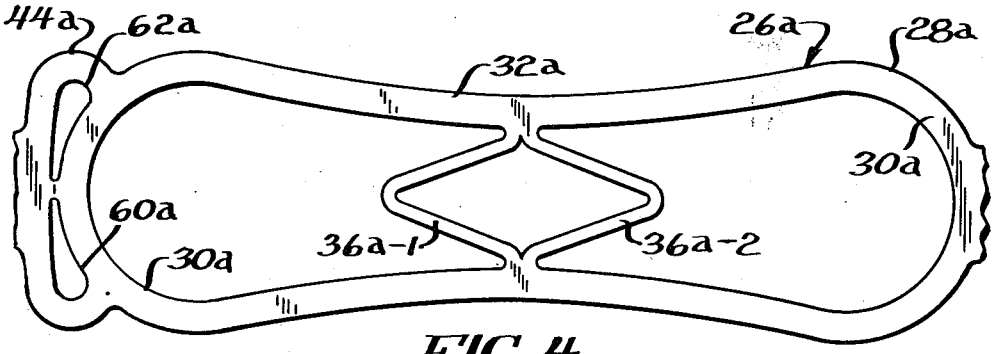
FIG. 4 is a view similar to FIG. 3 showing the somewhat different relative dimensions for carrying a different assembly of containers, such as a double four pack of bottles.

An embodiment of the invention adapted for carrying eight bottles is shown in FIGS. 4 and 6. The parts are generally similar or identical to those previously shown and described, and therefore similar parts are identified by similar numerals with the addition of the suffix a. Points of distinction are that the strip **28*a* is narrower than the strip 28, while the intermediate strip 36*a* is considerably shorter, having to span only two bottles 20*a*, instead of three cans. Accordingly, as seen in FIG. 4 the strips 36*a*-1 and 36*a*-2 do not extend as far to the right and to the left as is the case with the corresponding intermediate strip portions in FIG. 2**.

The bottles as shown in FIG. 6 are arranged in two groups of four, and each group preferably is held together by a plastic carrier (not shown) receiving the necks of the bottles, and generally is similar to the plastic six pack carriers of FIG. 1, but with smaller holes having greater spacing. The two four pack units are arranged with one vertically above the other, with the strip **28*a* encircling the assemblage, and the intermediate strip 36*a* extending between the two four bottle units whereby the eight bottles are securely held together for transport, hanging from the handle 44*a***.

A further embodiment of the invention is shown in FIG. 7. This embodiment is generally similar to those previously disclosed, and similar parts are identified by similar numerals with the addition of the suffix b to avoid prolixity of discussion. The handle **44*b* is shown at the left end, as in FIGS. 3 and 4, but it could equally well be along the top as indicated in broken lines, and as previously shown in FIG. 2. The essential distinction of the present embodiment over prior embodiments is that the strips 36*b*-1 and 36*b*-2 ultimately forming the center strip 36 are of generally horseshoe-shaped configuration, rather than V-shaped. Thus, there are side legs 72-1 and 74-1 in close proximity and near parallelism with the adjacent reverse curved sections 32*b*, connected by a large arcuate section 76. Similarly, there are straight legs 72-2 and 74-2 interconnected by a large arcuate section 78. With the proximity to the reversely curved strip portions 32*b*, there are integral connections 80-1, 80-2, 82-1 and 82-2 between the respective legs and the respective reverse curvature portions of the strip 30*b*. These interconnections are rather narrow, and may be weakened by means such as score lines for ready severability during assembly of the carrier with the containers. Prior to such severing, the connections hold the center strip portions 36*b*-1 and 36*b*-2 in the same plane as the balance of the carrier 36*b*** without requiring any separate handling thereof.

The carrier of FIG. 7 is especially adapted for retaining eight bottles, but it could be used for a double six pack if dimensions were changed accordingly. Additional embodiments especially adapted to carry eight bottles are shown in FIGS. 8, 9 and 10. With reference at this time to FIG. 8, parts there are similar to those previously described, and similar numerals are utilized with the addition of the suffix c to identify like parts. Distinctions reside in the fact that the arcuate end portions **30*c* are of considerably greater arcuate extent than in previous embodiments, and instead of having the arcuate portions at opposite ends of the carrier merge into a single rather long portion of reverse curvature, there are rather short portions of reverse curvature of considerably smaller radius joining the end portions to straight side portions 86. This results in the top and bottom portions of the strip 86 being considerably closer together than in previous embodiments of the invention. The stip portions ultimately to form the intermediate or divider strip 36***c* are again of generally horseshoe shape, but considerably narrower (less height from top to bottom in FIG. 8). The adjacent end of the leg pairs 73*c*-1, 74*c*-1 and 72*c*-2, 74*c*-2 are integrally interconnected by roots 88-1 and 88-2. The roots have margins of relatively small radius to avoid stress concentrations, and a central aperture 90 is defined by the roots and associated structure.

Attention next should be directed to the embodiment of FIG. 9 in which like numerals are again utilized to identify similar parts, this time with the addition of the suffix d. Production of the embodiment illustrated in FIG. 9 results in a minimum of scrap, since the width of the blank is minimized. The arcuate end portions 30*d* extend over only 180°, and are of shorter radius than in previous embodiments. There are no reversely curved or inverse sections such as 32 or 84, but rather the straight side portions 86*d* are tangent to the arcuate end portions 30*d*. It will be apparent in connection with both embodiments of FIGS. 8 and 9 that the roots 88-1 and 88-2 could be scored or otherwise weakened to facilitate severence thereof upon assembly of the carrier with a plurality of bottles.

The final embodiment of the invention as disclosed herein is shown in FIG. 10. Similar parts again are identified by like numbers with the addition of the suffix e. This form of the invention is similar to that in FIG. 9 in that there are straight upper and lower portions 86*e* of the outer strip 28*e*. In this instance the curved end portions 30*e* are of greater diameter and the straight portions 86*e* thus are spaced farther apart. The portions 36*e*-1 and 36*e*-2 destined to form the intermediate strip are semi-circular in the present form of the invention, and are joined along the horizontal median line of the carrier 36*d* by a crossbar 88 integrally formed therewith and having fillets formed by small radii. As in prior forms of the invention the two strip portions 36*e*-1 and 36*e*-2 are being pulled together, not apart, and there is no particular danger of a split between these strip portions. Nevertheless, it is preferred that the strip portions be joined to one another by a small radius at either end to avoid any problems of splitting or tearing.

In each embodiment of the invention as shown and described herein there is provided a band-type carrier for a 12-pack of cans or an eight pack of bottles which has a band encircling the outside of the package, and which further has an intermediate band extending between containers within the package, whereby every container is engaged by a portion of the pack band or package unit carrier, thereby to provide enhanced stability for the overall package. The carrier is inexpensive to produce, being made from a thermoplastic resin such as polyethylene, and being stamped from a continuous web of such material with the scrap being capable of reclamation. In each instance the intermediate strip or band comprises initially a pair of narrow strips initially displaced from one another, which strips are pulled into close contiguity upon assembly with the containers, forming in effect a single strip. The carrier forms surface engagement with the containers as the parts are stressed into position.

The specific examples of the invention as herein shown and described are for illustrative purposes. Various changes in structure will no doubt occur to those skilled in the art, and will be understood as forming a part of the present invention insofar as they fall within the spirit and scope of the appended claims.

The invention is claimed as follows:

1. A package unit comprising a plurality of cylindrical containers arranged in rows and columns, and a package unit carrier comprising a first resilient strip circumscribing all of said containers in surface contact therewith, and an intermediate resilient strip integral with said first strip and extending between spaced portions thereof, said intermediate strip extending between predetermined adjacent containers in surface engagement therewith, each of said containers being engaged by at least one of said strips to provide a stable package.

2. A package unit as set forth in claim 1 and further including integral handle means on said first strip.

3. A package unit as set forth in claim 1 wherein said intermediate strip comprises two bands interconnected at their ends integrally with said first strip and lying in close contiguous relation to one another.

4. A package unit as set forth in claim 1 wherein said plurality of containers comprises 12 cans, and additional carrier means comprising 12 bands respectively gripping the plurality of said cans beneath the beads thereof, at least certain of said bands being interconnected.

5. A package unit as set forth in claim 4 wherein said bands are interconnected in two groups of six and provide two six packs of cans, said intermediate strip lying between said two six packs.

6. A package unit as set forth in claim 1 wherein said plurality of containers comprise eight bottles in two groups of four, said intermediate strip lying between said groups of four.

7. A package unit carrier comprising a first integral resilient plastic strip formed as a continuous loop, handle means integral therewith, and an intermediate strip extending across said loop and having opposite ends integral with said first strip.

8. A package unit carrier as set forth in claim 7 wherein said loop lies substantially in a common plane, said intermediate strip lying in the same common plane but displaced from a straight line between said opposite ends.

9. A carrier as set forth in claim 8 wherein said intermediate strip comprises a loop lying to one side of a straight line between said opposite ends, and further including additional severable attachments between said first strip and said intermediate strip.

10. A carrier as set forth in claim 8 wherein said loop has major and minor axes, said intermediate strip having said ends disposed substantially along said minor axis and being displaced in the direction of said major axis.

11. A carrier as set forth in claim 10 wherein said intermediate strip comprises a loop lying to one side of a straight line between said opposite ends, and further including additional severable attachments between said first strip and said intermediate strip.

12. A carrier as set forth in claim 10 wherein said intermediate strip has a re-entrant shape.

13. A carrier as set forth in claim 12 wherein said intermediate strip is interconnected adjacent said ends by readily severable areas.

14. A carrier as set forth in claim 12 wherein said intermediate strip is V-shaped.

15. A carrier as set forth in claim 12 wherein said intermediate strip is of horseshoe shape.

16. A carrier as set forth in claim 12 wherein said intermediate strip is at least in part arcuate.

17. A carrier as set forth in claim 16 wherein said intermediate strip is at least in part semicircular.

18. A carrier as set forth in claim 7 wherein said loop comprises two arcuate ends and two portions interconnecting said arcuate ends.

19. A carrier as set forth in claim 18 wherein at least one of said interconnecting portions comprises a reverse curve.

20. A carrier as set forth in claim 18 wherein both of said interconnecting portions comprise reverse curves.

21. A carrier as set forth in claim 17 wherein at least one of said connecting portions comprises a straight side.

22. A carrier as set forth in claim 21 wherein both of said interconnecting portions comprise straight sides.

23. A package unit carrier comprising a first integral resilient plastic strip formed as a continuous loop, handle means integral therewith, and an intermediate strip extending across said loop and having opposite ends integral with said plastic strip, said intermediate strip comprising a pair of bands of equal length and mirror-image shape each greater in length than a straight line between said opposite ends, and adapted to be pulled into side-by-side relationship.

24. A carrier as set forth in claim 3 wherein said bands comprise confronting V-shapes.

25. A carrier as set forth in claim 23 wherein said bands are of confronting horseshoe shape.

26. A carrier as set forth in claim 25 and further including additional, readily severable attachments between said bands and said loop.

27. A carrier as set forth in claim 23 wherein said bands are of substantially semicircular shape.

* * * * *